US005250122A

United States Patent [19]

Uchida et al.

[11] Patent Number: 5,250,122

[45] Date of Patent: Oct. 5, 1993

[54] HEAT TREATING OIL COMPOSITION

[75] Inventors: Hitoshi Uchida; Saburo Koyama, both of Ichihara; Eiichi Nakamura, Tokyo, all of Japan

[73] Assignee: Idemitsu Kosan Co., Ltd., Tokyo, Japan

[21] Appl. No.: 961,649

[22] Filed: Oct. 16, 1992

[30] Foreign Application Priority Data

Oct. 18, 1991 [JP] Japan ..... 3-271073

[51] Int. Cl.[5] ..... C21D 1/58

[52] U.S. Cl. ..... 148/29

[58] Field of Search ..... 148/29

[56] References Cited

U.S. PATENT DOCUMENTS 3,159,510 12/1964 Rozalsky ..... 148/29

3,498,850 3/1970 Morton ..... 148/29

*Primary Examiner*—Peter D. Rosenberg

*Attorney, Agent, or Firm*—Antonelli, Terry, Stout & Kraus

[57] ABSTRACT

There is disclosed a heat treating oil composition which comprises (A) at least one base oil selected from a mineral oil and a synthetic oil each having a sulfur content of not more than 300 ppm and (B) at least one member selected from alkaline earth metal salts of salicylic acid. There is also disclosed a heat treating oil composition which comprises (I) a base oil having a sulfur content of 3 to 1000 ppm consisting of said (A) component and (C) at lease one member selected from a sulfur and a sulfur compound, along with (II) various additives for quenching.

This heat treating oil composition is suitable for quenching under the condition of a high oil temperature and capable of obtaining a treated metal excellent in brightness and having a minimized distortion.

10 Claims, No Drawings

HEAT TREATING OIL COMPOSITION

BACKGROUND OF THE INVENTION

1. Field of the Invention

The present invention relates to a heat treating oil composition, particularly a quenching oil composition. More particularly, it relates to a new type heat treating oil composition excellent in the stability at high temperature, suitable for quenching under the condition of a high oil temperature and capable of providing an object to be treated with excellent and long surviving brightness.

2. Description of Related Arts

Conventionally, a heat treatment, for example a quenching treatment has been given by feeding a metal heated to a high temperature into a quenching oil at 60° to 150° C. and quenching and hardening it. During the process of this quenching treatment, the metal preferably is quenched even at a higher oil temperature such as 170° to 250° C. to make the effective correction for a distortion.

However, conventionally known heat treating oils, for example those which are mixed with mineral oil, fatty acid, alkenyl succinimide and the like (Japanese Patent Applications Laid Open No. 4508/1977, No. 15913/1986, No. 106710/1986 and the like) have the poor stability at high temperatures. Thus, when they are used at high oil temperatures, they have encountered various problems that the metal is not hardened or does not have sufficiently high brightness or the life span of said brightness is short. Meanwhile, inferior brightness has been blamed as one of the reasons for an increase of distortion associated with quenching.

On the other hand, the heat treating oil can have the improved stability at high temperatures by comprising a highly purified base oil. It has been known, however, that unevenness is liable to occur in association with cooling because of this heat treating oil, resulting in an increase of inferior brightness, quenching unevenness and quenching distortion.

Moreover, a martempering treatment (at a liquid temperature around 230° C.) using salt has also been known as suitable for decreasing the quenching distortion. But this treatment has been found to have poorer working efficiency than that of quenching oil, accompanied even by environmental problems.

Thus, the present inventors have made intensive studies with a view to finding a solution in these problems and developing a heat treating oil composition capable of quenching at high oil temperatures and obtaining a treated metal having excellent brightness and free of the distortion.

As the result, it has been found that said objects can be achieved by a heat treating oil composition comprising a highly purified mineral oil or synthetic oil as a base oil and an alkaline earth metal salt of salicylic acid or comprising a base oil consisting of a highly purified mineral oil or synthetic oil and a specific content of sulfur, along with various additives for quenching. The present invention has been completed on the basis of this finding.

SUMMARY OF THE INVENTION

Therefore, the present invention provides a heat treating oil composition which comprises (A) at least one base oil selected from a mineral oil and a synthetic oil each having a sulfur content of not more than 300 ppm and (B) an alkaline earth metal salt of salicylic acid.

The present invention also provides a heat treating oil composition which comprises (I) a base oil having a sulfur content of 3 to 1000 ppm consisting of (A) at least one member selected from a mineral oil and a synthetic oil each having a sulfur content of not more 300 ppm and (C) at least one member selected from a sulfur and a sulfur compound and (II) additives for quenching.

Furthermore, the present invention also provides a method for quenching which comprises quenching with either of above-mentioned heat treating oil compositions at a high oil temperature.

DESCRIPTION OF THE PREFERRED EMBODIMENTS

The (A) component of the present invention is used as a base oil singly or with the adjustment of the sulfur content as will be described later. This (A) component includes at least one member selected from a mineral oil and a synthetic oil each having a sulfur content of not more than 300 ppm. When the sulfur content of the mineral oil is more than 300 ppm, inferior brightness or the quenching distortion is liable to occur in the object to be treated. On the other hand, when the mineral oil is even more highly purified to have the sulfur content of preferably not more than 100 ppm, more preferably not more than 30 ppm, the object treated and quenched by using the composition of the present invention is provided with brightness having a longer span of life. These conditions of the sulfur content hold good for the synthetic oil as well.

The kind of mineral oil and synthetic oil to be used as the (A) component is not particularly limited. Examples of the mineral oil to be used herein are the highly purified product of a paraffinic mineral oil, an intermediate mineral oil and a naphthenic mineral oil, each having the sulfur content satisfying said conditions. Examples of the synthetic oil to be used herein include various oils, for example an olefin (co) polymer having from 2 to 16 carbon atoms (including an oligomer), alkylbenzene, alkylnaphthalene, a polyphenyl hydrocarbon, various esters including fatty acid esters of neopentylglycol, trimethylolpropane, pentaerythritol and the like. An olefin oligomer or its hydrogenated product having from 8 to 12 carbon atoms is most suitable among them.

Of these mineral oils and synthetic oils, not only one member can be used singly but also two or more as their mixture at a discretionary ratio. The so obtained (A) component ordinarily has a kinematic viscosity of 2 to 100 cSt at 100° C.

Said (A) component is mixed with sulfur and a sulfur compound as the (C) component of the present invention to obtain a base oil having a total sulfur content of 3 to 1000 ppm, preferably 5 to 800 ppm, capable of decreasing the quenching distortion, providing brightness having a longer span of life and improving brightness in the initial phase of quenching. It is even more preferable for the base oil to have a nitrogen content of not more than 30 ppm, especially 20 ppm, along with the total sulfur content of 3 to 1000 ppm.

Of said sulfur and the sulfur compounds, not only one member can be used singly but also two or more in their discretionary combination.

Various sulfur compounds can be used to improve brightness of the object to be treated, including compounds of sulfides, disulfides, polysulfides, mercaptans and thiophenes. More specifically, sulfides include diethylsufide, di-n-propylsulfide, di-n-butylsulfide, di-isobutylsulfide, di-tert-butylsulfide, di-n-hexylsulfide, diphenylsufide, dibenzylsulfide and the like. Disulfides include diethyldisulfide, di-n-propyldisulfide, di-n-butyldisulfide, di-iso-butyldisulfide, di-sec-butyldisulfide, di-tert-butyldisulfide, di-n-heptyldisulfide, di-tert-heptyldisulfide, di-tert-lauryldisulfide, diphenyldisulfide, dibenzyldisulfide and the like. Polysulfides include dibenzylpolysulfide. Mercaptans include n-butylmercaptan, n-hexylmercaptan, tert-dodecylmercaptan, n-tetradecylmercaptan, n-cetylmercaptan, thiophenol, p-thiocresol and the like. Further, thiophenes include thiophene, dibenzothiophene and the like. Besides, there can be mentioned sulfurized alkylphenate of an alkaline earth metal, a dithiophosphoric acid metal (Zn-DTP and the like), a mineral oil having a sulfur content of not more than 2.0%, a sulfurized mineral oil, olefin sulfide, a sulfurized fat and the like. It is preferable that this mineral oil having the sulfur content of not more than 2.0% has particularly a nitrogen content of not more than 400 ppm as well.

However, among the sulfur compounds, for example sulfoxide or sulfonic acid or its salts practically cannot improve brightness or reduce the quenching distortion in the object to be treated.

The alkaline earth metal salt of salicylic acid as the (B) component of the present invention is incorporated into (I) the base oil consisting of the (A) component singly or the (A) component and the (C) component in combination. Examples of this alkaline earth metal salt of salicylic acid include various compounds, and most suitable is a salicylate compound represented by the following general formula (1):

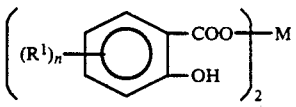

(1)

wherein $R^1$ is an alkyl group having from 8 to 20 carbon atoms, n is an integer of from 1 to 4 and M is Ca, Ba or Mg.

The salicylate compound having a total base number (TBN) of not more than 500 mgKOH/g, preferably 100 to 400 mgKOH/g is effective in improving brightness of the object to be treated. Particularly, calcium salicylate and magnesium salicylate are most suitable.

Of these alkaline earth metal salts of salicylic acid, not only one member alone can be used singly but also two or more in their discretionary combination. The mixing amount thereof is not particularly limited and is variable depending upon circumstances but ordinarily 0.1 to 50% by weight, preferably 1 to 30% by weight of a compound is mixed in the composition as a whole. When the mixing amount is less than 0.1% by weight, the effect aimed by the present invention often cannot be obtained. On the other hand, when the mixing amount is more than 50% by weight, the effect is not improved in proportion thereto to an economical disadvantage.

Alkaline earth metal salts of sulfonic acid and phenol as the (D) component of the present invention are used in the same way as the alkaline earth metal salt of salicyclic acid of the (B) component, but it is necessary that the (D) component should be incorporated into the base oil consisting of the (A) component and the (C) component in combination. Even if the (D) component is incorporated into the base oil consisting of the (A) component singly, the effect aimed by the present invention often cannot be obtained.

The various alkaline earth metal salts of sulfonic acid and phenol can be used in the present invention.

Most suitable among the alkaline earth metal salts of sulfonic acid is, for example a sulfonate compound represented by the following general formula (2):

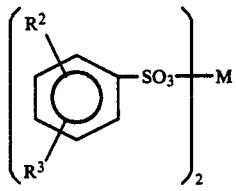

(2)

wherein $R^2$ and $R^3$ each are a hydrogen atom or an alkyl group having from 12 to 24 carbon atoms, provided that $R^2$ and $R^3$ are not the hydrogen atom at the same time; and M is same as defined above.

Most suitable among the alkaline earth metal salts of phenol is a phenate compound of the general formula (3):

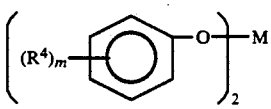

(3)

wherein $R^4$ is an alkyl group having from 9 to 24 carbon atoms, m is an integer of from 1 to 4 and M is same as defined above.

Of these alkaline earth metal salts of sulfonic acid and phenol, not only one member alone can be used singly but also two or more in their discretionary combination. Furthermore, they can be combined with the (B) component. Meanwhile, conditions of their total base number (TBN) and mixing amount are same as those of the alkaline earth metal salt of salicyclic acid as the (B) component.

Basically, the composition of the present invention is prepared by incorporating (II) the additives such as (B) component and (D) component into (I) the base oil consisting of the (A) component singly or the (A) component and (C) component in combination and, when desired, (E) a barium compound, (F) an antioxidant and various other additives may as well be further mixed therein.

Various barium compounds can be used as the (E) component, but barium sulfonate and barium naphthenate are most effective. Of them, the barium sulfonate to be used herein is a neutral or basic barium sulfonate having a total base number (TBN) of 0 to 500 mgKOH/g.

The mixing amount of the barium compounds is not particularly limited and is variable depending upon the kind of each of (A) to (D) components, the kind of the object to be treated, the quenching conditions and further the property desired for the object to be treated and the like. But ordinarily 50 to 25,000 ppm (in terms of barium) of a barium compound is mixed with the composition as the whole. When these barium compounds are mixed, brightness is further improved and decreasing of the quenching distortion is expedited in the object to be treated particularly in the initial phases of quenching (with a new oil).

Ordinarily, the antioxidant of the (F) component is effective when 0.05 to 10% by weight thereof is mixed with the composition as the whole. Examples of this antioxidant include a hindered phenol antioxidant (for example, 2,6-di-tert-butylparacresol and the like), an amine antioxidant (for example, α-naphthylamine, phenylnaphthylamine, diphenylamine and the like) or a phosphoric antioxidant or the like.

Examples of the other additive include an cooling capacity improver (for example, polybutene, polymethacrylate and the like) and a brightness agent (for example, succinic acid, sorbitan ester, succinimide and the like).

A metal material such as steel material is subjected to a quenching treatment using a composition of the present invention by presetting a temperature of the composition as the heat treating oil preferably at an ordinary quenching temperature (around 60° to 150° C.) and more preferably at a higher temperature of 170° to 250° C. When the metal material such as steel material is treated and quenched by using the composition of the present invention under the condition of such a high oil temperature, cooling uneveness is hard to occur, the object to be treated is provided with excellent and long surviving brightness and further the distortion of the object to be treated is decreased. Furthermore, the composition of the present invention has the excellent stability at high temperatures and thus can be used for a long period of time.

Furthermore, the heat treating oil composition of the present invention is as effective in the tempering treatment as in the quenching treatment.

As stated above, the heat treating oil composition of the present invention is excellent in the quenching treatment at high oil temperatures as compared with conventional methods and further the performance of the composition can be improved to a great extent by combining various components of the present invention.

Therefore, the heat treating oil composition of the present invention will find very high usefulness in the quenching treatment at high oil temperatures.

Particularly, it will be very highly useful in the field of quenching precision parts such as carburized gear and bearing wherein a CAFE (Cooperated Average Fuel Economy) measure and an anti-noise measure are critical.

Next, the present invention will be described in greater detail with reference to examples and comparative examples.

Table 1 shows the mixing ratio of the components in all examples and comparative examples.

TABLE 1

| | | Examples | | | |
|---|---|---|---|---|---|
| | Mixing Ratio (% by weight) | 1 | 2 | 3 | 4 |
| A | Mineral oil 1 S content (0.5 wt %) | — | — | — | — |
| | Mineral oil 2 S content (300 ppm) | — | — | — | — |
| | Mineral oil 3 S content (100 ppm) | — | — | — | — |
| | Mineral oil 4 S content (3 ppm >) | 95 | 94.95 | — | — |
| | Synthetic oil*1 | — | — | 94 | 95 |
| B | Ca salicylate (TBN300) | 5 | 5 | 5 | 5 |
| C | Sulfurized Ca phenate | — | — | 1 | — |
| | Benzothiophene S content (17.4 wt %) | — | 0.05 | — | — |
| D | Ca sulfonate (TBN300) | — | — | — | — |
| | Ca phenate (TBN200) | — | — | — | — |
| E | Ba sulfonate (TBN200)*2 | — | — | — | — |
| F | α -naphthylamine | — | — | — | — |
| | Total sulfur content (ppm) | 3> | 100 | 300 | 3> |

| | | Examples | | | |
|---|---|---|---|---|---|
| | Mixing Ratio (% by weight) | 5 | 6 | 7 | 8 |
| A | Mineral oil 1 S content (0.5 wt %) | — | — | — | — |
| | Mineral oil 2 S content (300 ppm) | — | — | — | — |
| | Mineral oil 3 S content (100 ppm) | — | — | — | — |
| | Mineral oil 4 S content (3 ppm >) | 95 | 94.95 | — | 94 |
| | Synthetic oil*1 | — | — | 93.45 | — |
| B | Ca salicylate (TBN300) | 4 | 4 | 5 | 4 |
| C | Sulfurized Ca phenate | 1 | — | — | 1 |
| | Benzothiophene S content (17.4 wt %) | — | 0.05 | 0.05 | — |
| D | Ca sulfonate (TBN300) | — | — | — | — |
| | Ca phenate (TBN200) | — | — | — | — |
| E | Ba sulfonate (TBN200)*2 | — | 1 | 1 | 1 |
| F | α -naphthylamine | — | 0.5 | 0.5 | — |
| | Total sulfur content (ppm) | 300 | 100 | 100 | 300 |

| | | Examples | | | |
|---|---|---|---|---|---|
| | Mixing Ratio (% by weight) | 9 | 10 | 11 | 12 |
| A | Mineral oil 1 S content (0.5 wt %) | 5 | — | — | — |
| | Mineral oil 2 S content (300 ppm) | — | — | — | — |
| | Mineral oil 3 S content (100 ppm) | — | 95 | — | — |
| | Mineral oil 4 S content (3 ppm >) | 83.5 | — | 94.95 | 94.95 |
| | Synthetic oil*1 | — | — | — | — |
| B | Ca salicylate (TBN300) | 10 | 5 | — | — |
| C | Sulfurized Ca phenate | — | — | — | — |
| | Benzothiophene S content (17.4 wt %) | — | — | 0.05 | 0.05 |
| D | Ca sulfonate (TBN300) | — | — | — | 5 |
| | Ca phenate (TBN200) | — | — | 5 | — |
| E | Ba sulfonate (TBN200)*2 | 1 | — | — | — |
| F | α -naphthylamine | 0.5 | — | — | — |
| | Total sulfur content (ppm) | 250 | 100 | 100 | 100 |

| | | Comparative Examples | | |
|---|---|---|---|---|
| | Mixing Ratio (% by weight) | 1 | 2 | 3 |
| A | Mineral oil 1 S content (0.5 wt %) | 94.5 | 94.5 | 25 |
| | Mineral oil 2 S content (300 ppm) | — | — | — |
| | Mineral oil 3 S content (100 ppm) | — | — | — |
| | Mineral oil 4 S content (3 ppm >) | — | — | 70 |
| | Synthetic oil*1 | — | — | — |
| B | Ca salicylate (TBN300) | — | — | 5 |
| C | Sulfurized Ca phenate | — | 5 | — |
| | Benzothiophene S content (17.4 wt %) | — | — | — |
| D | Ca sulfonate (TBN300) | 5 | — | — |
| | Ca phenate (TBN200) | — | — | — |
| E | Ba sulfonate (TBN200)*2 | — | — | — |
| F | α -naphthylamine | 0.5 | 0.5 | — |
| | Total sulfur content (ppm) | 4730 | 6230 | 1250 |

| | | Comparative Examples | |
|---|---|---|---|
| | Mixing Ratio (% by weight) | 4 | 5 |
| A | Mineral oil 1 S content (0.5 wt %) | — | — |
| | Mineral oil 2 S content (300 ppm) | — | — |
| | Mineral oil 3 S content (100 ppm) | — | — |
| | Mineral oil 4 S content (3 ppm >) | 99.45 | 97.0 |
| | Synthetic oil*1 | — | — |
| B | Ca salicylate (TBN300) | — | — |

TABLE 1-continued

| | | | |
|---|---|---|---|
| C | Sulfurized Ca phenate | — | 2.5 |
| | Benzothiophene S content (17.4 wt %) | 0.05 | — |
| D | Ca sulfonate (TBN300) | — | — |
| | Ca phenate (TBN200) | — | — |
| E | Ba sulfonate (TBN200)*2 | — | — |
| F | α -naphthylamine | 0.5 | 0.5 |
| Total sulfur content (ppm) | | 100 | 750 |

*1A hydrogenated product of oligomer of olefin $C_{10}$
*2Ba sulfonate is a (D) component as well

EXAMPLES 1 TO 12 AND COMPARATIVE EXAMPLES 1 TO 5

These examples and comparative examples were carried out, as follows:

The test piece was a steel material S45C (a diameter of 10 mm×a length of 40 mm; a hardness of $H_{RC}16$). The test piece was fed into various quenching oils prepared according to the compositions shown in Table 1, treated and quenched. Quenching was carried out under the condition of an oil temperature of 200° C. The used mineral oil was a paraffinic mineral oil having a kinematic viscosity of 10cSt at 100° C.

The performance of the heat treating oil was evaluated by measurement with the changes of brightness after the test piece was treated and quenched with a new oil and an oil deteriorated by force.

Meanwhile, forced deterioration was conducted according to the Indiana Oxidation Test Method (IOT).

Manufacturing Conditions of Deteriorated Oil

| | |
|---|---|
| Oil temperature | 170° C. |
| Air | 10 liter/minute |
| Catalyst | Fe, Cu |

Determination of brightness performance (surface outlook)

◎: very good . . . No discolored parts in metallic lustre all over the surface.

○: good . . . Metallic lustre slightly reduced, with grayish parts.

Δ: fairly good . . . Partly turned black or brown.

X: no good . . . Black and brown all over, with no metallic lustre.

The results of evaluating the performance are shown in Table 2. Furthermore, in Examples 1 and 7, the objects to be treated were subjected to a quenching treatment using an deteriorated oil for 24 hours, resulting in a finding that all of them had a hardness of approximately $HR_{RC}45$.

TABLE 2

| IOT deteriorating time (hr) | Brightness | | | | | | | | |
|---|---|---|---|---|---|---|---|---|---|
| | Examples | | | | | | | | |
| | 1 | 2 | 3 | 4 | 5 | 6 | 7 | 8 | 9 |
| 0 | Δ | ○ | ○ | Δ | ○ | ◎ | ◎ | ◎ | ◎ |
| 24 | ◎ | ◎ | ◎ | ◎ | ◎ | ◎ | ◎ | ◎ | ◎ |
| 48 | ◎ | ◎ | ◎ | ◎ | ◎ | ◎ | ◎ | ◎ | ◎ |
| 72 | ◎ | ◎ | ◎ | ◎ | ◎ | ◎ | ◎ | ◎ | ◎ |
| 96 | ◎ | ◎ | ◎ | ◎ | ◎ | ◎ | ◎ | ◎ | ◎ |
| 120 | ◎ | ◎ | ◎ | ◎ | ◎ | ◎ | ◎ | ◎ | ◎ |
| 144 | ◎ | ◎ | ◎ | ◎ | ◎ | ◎ | ◎ | ◎ | ◎ |
| 168 | ◎ | ◎ | ◎ | ◎ | ◎ | ◎ | ◎ | ◎ | ◎ |
| 192 | Δ | Δ | Δ | Δ | Δ | ○ | ○ | Δ | ◎ |
| | Example | | | Comparative Examples | | | | | |
| | 10 | 11 | 12 | 1 | 2 | 3 | 4 | 5 | |
| 0 | Δ | ○ | ○ | Δ | Δ | X | ○ | ○ | |

TABLE 2-continued

| IOT deteriorating time (hr) | Brightness | | | | | | | |
|---|---|---|---|---|---|---|---|---|
| 24 | ◎ | ◎ | ◎ | ○ | ○ | ◎ | ○ | ○ |
| 48 | ◎ | ◎ | ◎ | ◎ | ◎ | ◎ | ○ | ○ |
| 72 | ◎ | ◎ | ○ | X | X | x | ○ | ○ |
| 96 | ◎ | ◎ | ○ | X | X | X | Δ | Δ |
| 120 | ◎ | X | X | X | X | X | X | X |
| 144 | ◎ | X | X | X | X | | | |
| 168 | ○ | X | X | X | X | | | |
| 192 | Δ | X | X | X | X | | | |

As evident from Table 2, in all examples of the present invention the evaluation resulted in a far better outcome than in the comparative examples. It is observed that the base oil consisting of the (A) component and (B) component was effective by comparing the Examples 1, 4 and 10 with Comparative Example 3. It also is observed that the more excellent results were obtained by incorporating the (B) component into the base oil consisting of the (A) component and the (C) component in combination (see Examples 2, 3 and 7). The comparison of Examples 11 and 12 with Comparative Examples 2, 4 and 5 shows that the base oil consisting of the (A) component and the (C) component in combination and incorporating the the (D) component was effective. Moreover, there is a finding that the marked effect was obtained by the base oil incorporating the additional additives of (E) component and the (F) component (see Examples 6 to 9).

What is claimed is:

1. A heat treating oil composition which comprises (A) at least one base oil selected from a mineral oil and a synthetic oil each having a sulfur content of not more than 300 ppm and (B) an alkaline earth metal salt of salicylic acid.

2. A heat treating oil composition which comprise (I) a base oil having a sulfur content of 3 to 1000 ppm consisting of (A) at least one member selected from a mineral oil and a synthetic oil each having a sulfur content of not more than 300 ppm and (C) at least one member selected from sulfur and a sulfur compound and (II) (B) an alkaline earth metal salt of salicylic acid.

3. A heat treating oil composition according to any one of claims 1 and 2, comprising a mineral oil having a sulfur content of not more 100 ppm.

4. A heat treating oil composition according to any one of claims 1 and 2, comprising a synthetic oil which consists essentially of an olefin oligomer having from 8 to 12 carbon atoms or hydrogenated product of the olefin oligomer.

5. A heat treating oil composition according to any one of claims 1 and 2, further comprising (E) a barium compound as an additional additive.

6. A heat treating oil composition according to claim 3, further comprising (E) a barium compound as an additional additive.

7. A heat treating oil composition according to claim 4, further comprising (E) a barium compound as an an additional additive.

8. A method for quenching which comprises quenching with the heat treating oil composition according to any one of claims 1 and 2 at a high oil temperature.

9. A heat treating oil composition according to any one of claims 1 and 2, wherein the alkaline earth metal salt of salicylic acid (B) is present in an amount of 0.1 to 50% by weight based on the total weight of the composition.

10. A heat treating oil composition according to any one of claims 1 and 2, wherein the alkaline earth metal salt of salicyclic acid (B) is present in an amount of 1 to 30% by weight based on the total weight of the composition.

* * * * *